US012607410B2

(12) United States Patent
Luo

(10) Patent No.: US 12,607,410 B2
(45) Date of Patent: Apr. 21, 2026

(54) TUNNEL TYPE HYBRID COOLING STEAM RECYCLING APPARATUS

(71) Applicants: BIG SUN ENERGY TECHNOLOGY INC., Hukou Township, Hsinchu County (TW); Chia Ching Luo, Hukou Township, Hsinchu County (TW)

(72) Inventor: Chia Ching Luo, Hukou Township, Hsinchu County (TW)

(73) Assignees: BIG SUN ENERGY TECHNOLOGY INC., Hsinchu County (TW); Chia Ching Luo, Hsinchu County (TW)

( * ) Notice: Subject to any disclaimer, the term of this patent is extended or adjusted under 35 U.S.C. 154(b) by 147 days.

(21) Appl. No.: 18/653,284

(22) Filed: May 2, 2024

(65) Prior Publication Data

US 2024/0377139 A1 Nov. 14, 2024

(30) Foreign Application Priority Data

May 10, 2023 (TW) ..... 112117375

(51) Int. Cl.
*F28B 1/02* (2006.01)
*F28B 1/00* (2006.01)
(Continued)

(52) U.S. Cl.
CPC ..... *F28B 1/02* (2013.01); *F28B 1/00* (2013.01); *F28B 3/00* (2013.01); *F28B 3/06* (2013.01)

(58) Field of Classification Search
CPC ..... F28B 1/02; F28B 1/00; F28B 3/00; F28B 3/06
(Continued)

(56) References Cited

U.S. PATENT DOCUMENTS 3,834,133 A * 9/1974 Bow ..... F28B 3/04 261/36.1
4,224,797 A * 9/1980 Kelly ..... F01K 11/02 60/676
(Continued)

FOREIGN PATENT DOCUMENTS

AU 617462 B2 11/1991
CN 207163254 U 3/2018
(Continued)

OTHER PUBLICATIONS

Office Action for JP Application No. 2024-075446 dated Apr. 1, 2025 and its English translation is attached (3 pages).

*Primary Examiner* — Joel M Attey
(74) *Attorney, Agent, or Firm* — Muncy, Geissler, Olds & Lowe, P.C.

(57) ABSTRACT

A tunnel type hybrid cooling steam recycling apparatus includes: a housing; air-cooling heat exchanging plates disposed on an outer surface of the housing; a chamber, formed in the housing; a mesh steam tunnel disposed in the chamber; a steam inlet penetrating through the housing; spraying heads disposed in the chamber; and a water outlet penetrating through the housing. Steam supplied into the mesh steam tunnel through the steam inlet is condensed into condensed water. In a hybrid mode, the spraying heads provide cooling spray into the chamber to dissipate heat in a hybrid manner in conjunction with the housing and the air-cooling heat exchanging plates.

9 Claims, 3 Drawing Sheets

(51) Int. Cl.
*F28B 3/00* (2006.01)
*F28B 3/06* (2006.01)

(58) Field of Classification Search
USPC ..... 165/113
See application file for complete search history.

(56) References Cited

U.S. PATENT DOCUMENTS 4,402,332 A * 9/1983 Bradshaw ..... F28D 21/0014 165/47
4,449,368 A 5/1984 Haynie
5,925,291 A * 7/1999 Bharathan ..... F28B 3/04 261/DIG. 32
8,756,945 B2 6/2014 Ludvig et al.
9,206,708 B2 * 12/2015 Moriyama ..... F01K 21/047
2003/0150233 A1 * 8/2003 Jensen ..... B01D 5/0036 62/100
2005/0109032 A1 * 5/2005 Harpster ..... F28B 1/02 60/685
2005/0198995 A1 * 9/2005 Lee ..... F25B 49/027 62/506
2015/0075963 A1 * 3/2015 Yabe ..... B01D 1/305 202/180

FOREIGN PATENT DOCUMENTS

CN 209605612 U 11/2019
CN 113883756 A 1/2022
CN 215723157 U 2/2022
CN 115949961 A 4/2023
FR 1520506 A 4/1968
JP H11118362 A 4/1999
JP H11118364 A 4/1999
JP 2007163136 A 6/2007

* cited by examiner

TUNNEL TYPE HYBRID COOLING STEAM RECYCLING APPARATUS

CROSS-REFERENCE TO RELATED APPLICATIONS

This application claims priority of No. 112117375 filed in Taiwan R.O.C. on May 10, 2023, the entire content of which is hereby incorporated by reference.

FIELD OF THE INVENTION

This disclosure relates to a steam recycling apparatus, and more particularly to a tunnel type hybrid cooling steam recycling apparatus.

DESCRIPTION OF RELATED ART

Steam condensers have been widely used in today's steam turbine power plants to condense the steam exhausted by the steam turbine and achieve steam recycling effects. A conventional steam condenser has a chamber connected to a steam outlet of the steam turbine, and the cooling water flows in a heat exchange tube in the chamber. The steam exhausted from the steam turbine enters the chamber and contacts the heat exchange tube. The cooling water flowing into the heat exchange tube absorbs the latent heat of the high-temperature steam, and the steam is condensed into water so that the steam can be recycled. Another conventional steam condenser has a chamber, in which the heat exchange tube (steam conduit) is disposed and connected to the steam outlet of the steam turbine. The cooling water in the chamber cools the steam conduit, and the steam is recycled.

The above-mentioned steam condensers need a lot of cooling water and heat exchange tubes, and the cost cannot be effectively decreased. In addition, the steam flowing either inside or outside the heat exchange tube causes the noise and the wear of the heat exchange tube.

Therefore, the above-mentioned problems need to be solved.

SUMMARY OF THE INVENTION

It is therefore an objective of this disclosure to provide a tunnel type hybrid cooling steam recycling apparatus achieving the quick cooling and decreasing the noise.

To achieve the above-identified objective, this disclosure provides a tunnel type hybrid cooling steam recycling apparatus including: a housing; air-cooling heat exchanging plates disposed on an outer surface of the housing; a chamber formed in the housing; a mesh steam tunnel disposed in the chamber; a steam inlet penetrating through the housing; spraying heads disposed in the chamber; and a water outlet penetrating through the housing. Steam supplied into the mesh steam tunnel through the steam inlet is condensed into condensed water. In a hybrid mode, the spraying heads provide cooling spray into the chamber to dissipate heat in a hybrid manner in conjunction with the housing and the air-cooling heat exchanging plates.

With the above-mentioned embodiment, the longitudinal steam tunnel having the large aperture can be used to buffer the flow of the high-pressure steam, and the layers of metal meshes can be used to reduce the energy and pressure of the steam, and then metal wool components are used to absorb the steam and perform silencing. Thus, quick cooling can be achieved by air cooling and water cooling, and the low-noise steam recycling can be achieved.

In order to make the above-mentioned content of this disclosure more obvious and be easily understood, preferred embodiments will be described in detail as follows in conjunction with the accompanying drawings.

DETAILED DESCRIPTION OF THE INVENTION

Figure 1:
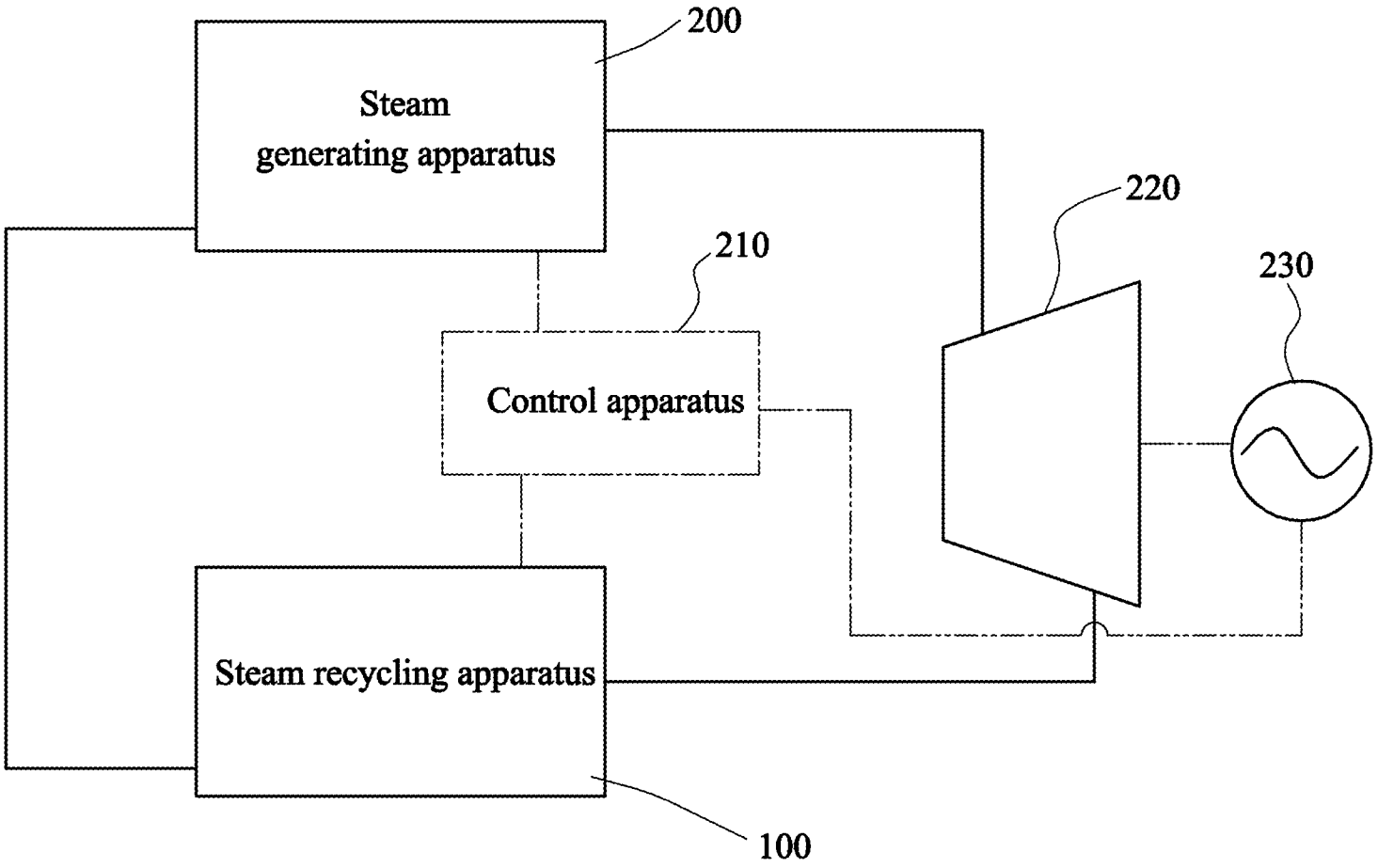
FIG. 1 is a schematic view showing a steam power generation system using a steam recycling apparatus according to a preferred embodiment of this disclosure.

FIG. 1 is a schematic view showing a steam power generation system using a steam recycling apparatus according to a preferred embodiment of this disclosure. Referring to FIG. 1, the steam power generation system includes a steam recycling apparatus 100, a steam generating apparatus 200, a control apparatus 210, a turbine 220 and a generator 230. In FIG. 1, the electrical connection path is indicated by the phantom line, and the physical conduit connection path is indicated by the solid line. The control apparatus 210, which may be implemented by a controller, is electrically connected to units such as the steam recycling apparatus 100, the steam generating apparatus 200, the generator 230 and the like, and controls operations of these units. The steam recycling apparatus 100 generates the high-pressure steam flowing to the turbine 220. The turbine 220 converts the kinetic energy of the high-pressure steam into the mechanical energy, and is coupled to the generator 230, which converts the mechanical energy into the electrical energy. The high-pressure steam passing through the turbine 220 becomes the low-temperature and low-pressure steam flowing to the steam recycling apparatus 100. The steam recycling apparatus 100 condenses the steam into water, and the steam generating apparatus 200 receives the water and generates the steam, or another external unit receives the water for further applications.

Figure 2:
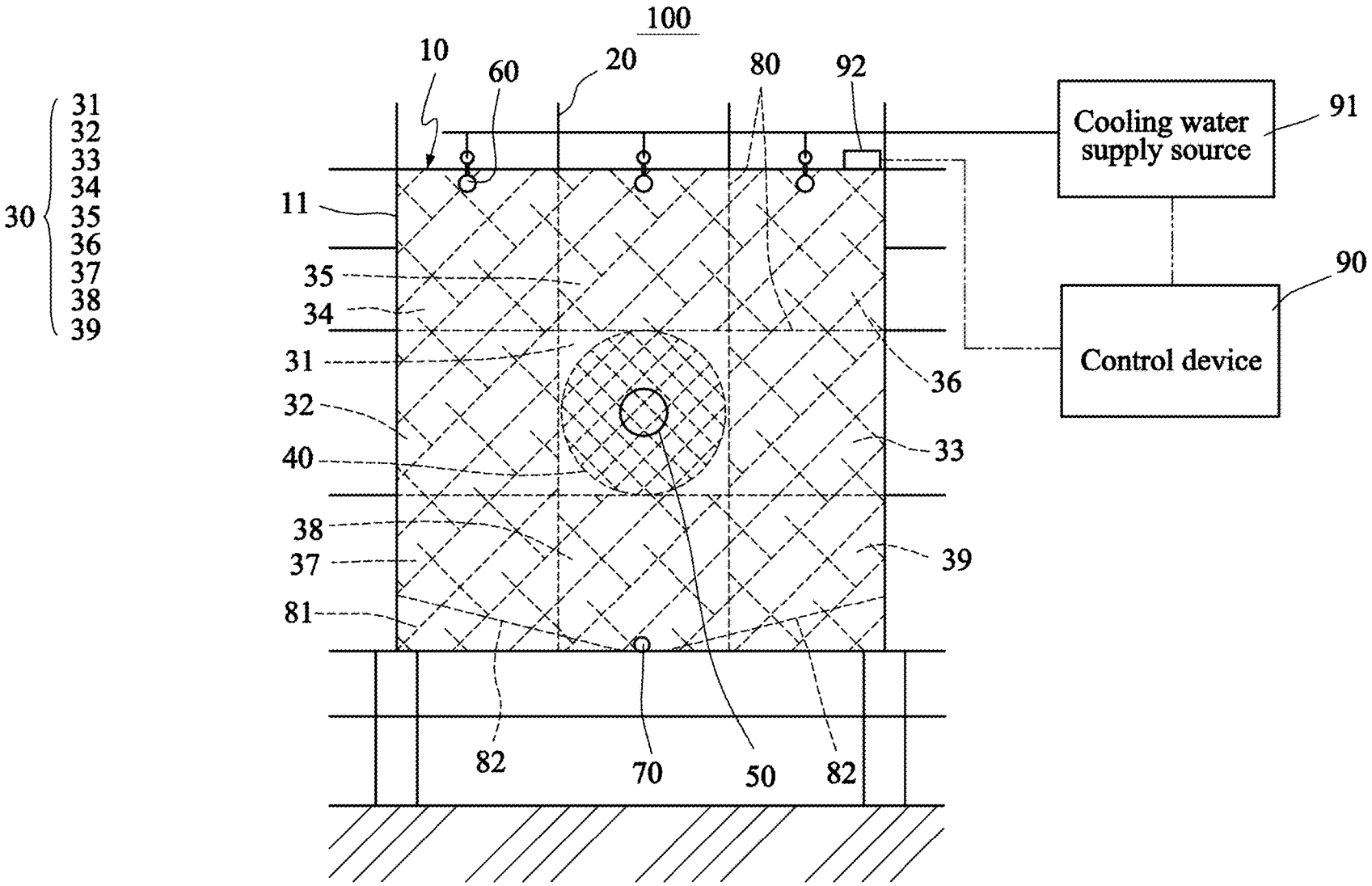
FIG. 2 is a partially schematic cross-sectional view showing the steam recycling apparatus of FIG. 1 in a side view direction.

FIG. 2 is a partially schematic cross-sectional view showing the steam recycling apparatus 100 of FIG. 1 in a side view direction. Referring to FIG. 2, the steam recycling apparatus 100 of this example is a tunnel type hybrid cooling steam recycling apparatus disposed on the ground, building or structure body, and includes a housing 10, air-cooling heat exchanging plates 20, a chamber 30, a mesh steam tunnel 40, a steam inlet 50, spraying heads 60 and a water outlet 70. The air-cooling heat exchanging plates 20 are disposed on an outer surface 11 of the housing 10 and in contact with the outside air, and perform heat dissipation in an air cooling manner, and may be implemented by heat dissipating fins. The chamber 30 is formed in the housing 10. The mesh steam tunnel 40 is disposed in the chamber 30. The steam inlet 50 penetrates through the housing 10, and is connected to the chamber 30. The spraying heads 60 are disposed in the chamber 30, and are disposed on an upper side of the chamber in this example. In other examples, the spraying heads 60 may be disposed on the upper, lower, left and/or right sides of the chamber. The water outlet 70 penetrates through the housing 10 and is connected to the chamber 30.

Upon the actual operation, the steam inlet 50 provides the steam, which enters the mesh steam tunnel 40 and is then condensed into condensed water. In a hybrid mode, the spraying heads 60 provides cooling spray into the chamber 30 and works in conjunction with the housing 10 and the air-cooling heat exchanging plates 20 to dissipate heat in a hybrid manner. It is understandable that the mesh steam tunnel 40 reduces the speed and pressure of the high-pressure steam, and eliminates a portion of kinetic energy. Thus, a portion of the steam is directly condensed in the mesh steam tunnel 40. The other portion of the steam passes through the mesh steam tunnel 40, is cooled by the housing 10 or other components, and is condensed into the condensed water.

In one example, the mesh steam tunnel 40 includes metal meshes, and has an axis extending in a horizontal direction. The metal meshes constitute a cylindrical metal cage, which provides a resisting force for the steam, and functions as a medium for condensing the steam. In another example, the mesh steam tunnel 40 includes circular, rectangular or other shaped stainless steel meshes surrounded by a cylindrical stainless steel mesh, achieves the functions of axially and radially reducing the energy and pressure of the steam, and provides the better effect.

The steam recycling apparatus 100 may further include mesh partitions 80, which partition the chamber 30 in a horizontal direction and a vertical direction, so that the chamber 30 is partitioned into sub-chambers connected together. The sub-chambers include a middle sub-chamber 31 and peripheral sub-chambers 32 to 39 surrounding the middle sub-chamber 31. The mesh steam tunnel 40 is positioned, by four mesh partitions 80, in the middle sub-chamber 31. The peripheral sub-chambers 32 to 39 accommodate metal wool components 81, such as steel wires or pieces of steel wool, for absorbing the steam, performing silencing, and condensing the steam into the condensed water. The spraying heads 60 provide cooling spray to one portion or the entire portion of the metal wool components 81 to cool the metal wool components 81. The steam recycling apparatus 100 may further include inclined plates 82 for guiding condensed water to flow to the water outlet 70. The inclined plates 82 may be positioned on structure walls of the housing 10, and tilted from two sides toward the middle position, so that the condensed water can flow to the middle position, and finally flow out of the water outlet 70. It is understandable that the mesh partitions 80 may be omitted as long as the metal wool components 81 can be mounted to a predetermined position.

The steam recycling apparatus 100 may further include a control device 90, a cooling water supply source 91 and a temperature sensor 92. The cooling water supply source 91 is electrically connected to the control device 90, and is connected to the spraying heads 60 via a physical conduit. In the hybrid mode, the cooling water supply source 91 provides cooling water to the spraying heads 60, which generate cooling spray and may also provide an appropriate amount of water to compensate for the steam loss. The temperature sensor 92 is disposed on the housing 10 or one of the air-cooling heat exchanging plates 20, and is electrically connected to the control device 90 that may be implemented by another controller. The control device 90 controls, according to a temperature signal of the temperature sensor 92, the cooling water supply source 91 to provide the cooling water to the spraying heads 60 generating the cooling spray. When the temperature represented by the temperature signal is higher than a predetermined temperature (e.g., 85° C. or another temperature), the control device 90 enters the hybrid mode. When the temperature represented by the temperature signal is lower than or equal to the predetermined temperature, the control device 90 enters an air cooling mode, and controls the cooling water supply source 91 not to provide the cooling water to the spraying heads 60, which do not generate the cooling spray.

In terms of water replenishment, a flow meter (not shown) is disposed at the water outlet 70 in one example. When the flow value of the flow meter does not reach a predetermined flow value, the control device 90 controls, according to the signal of the flow meter but not the temperature signal, the cooling water supply source 91 to provide the cooling water to the spraying heads 60, which generate the cooling spray. In another example, when the water level of the steam recycling apparatus and/or the water level of the water supply source of the steam generating apparatus are lower than a predetermined water level, the control device 90 controls the cooling water supply source 91 according to the water level signal of the water level gauge or sensor (not shown) but not the temperature signal, and the cooling water supply source 91 provides the cooling water to the spraying heads 60 so that the spraying heads 60 generate the cooling spray.

Figure 3:
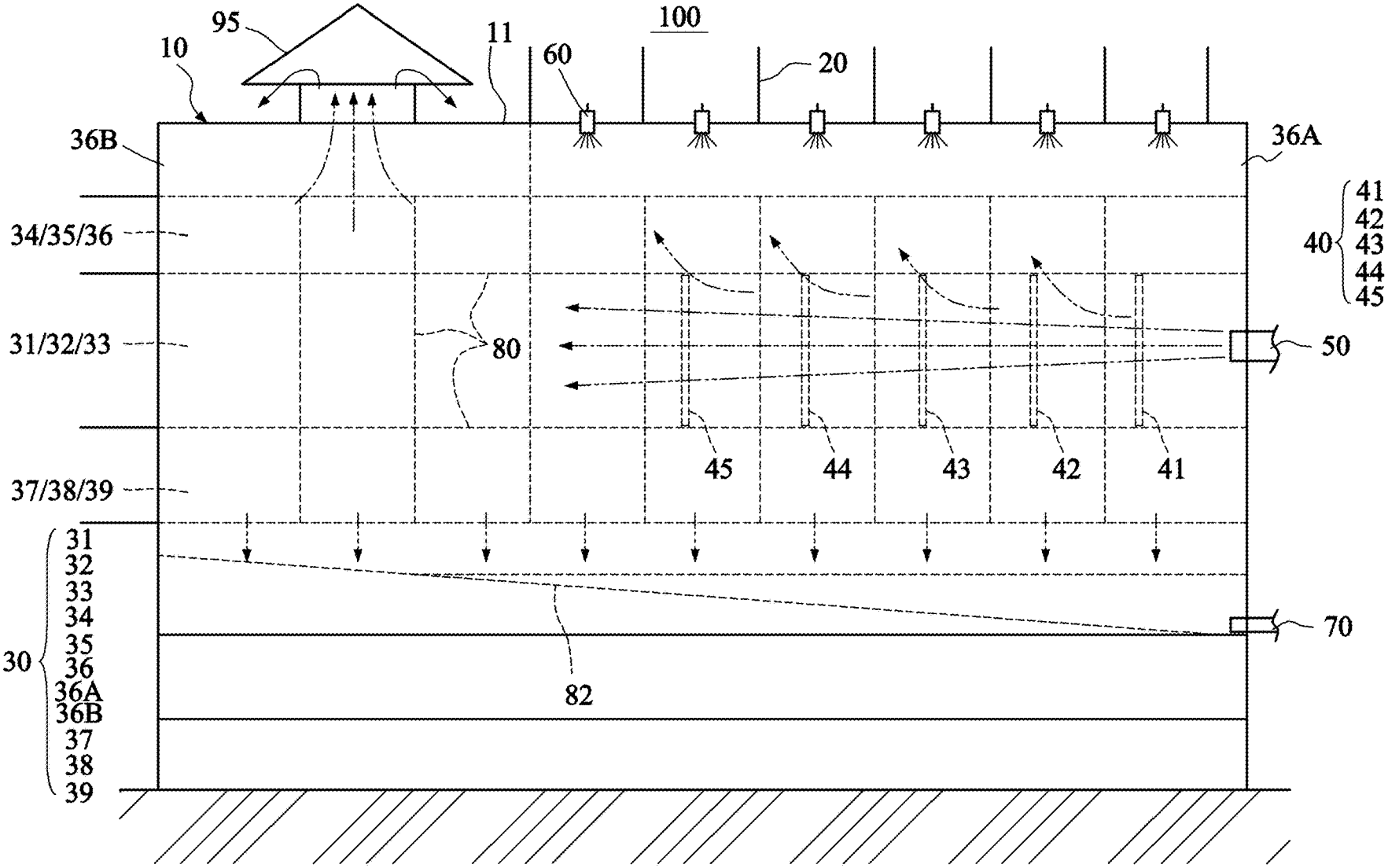
FIG. 3 is a schematic front view showing another example of the steam recycling apparatus of FIG. 1.

FIG. 3 is a schematic front view showing another example of the steam recycling apparatus of FIG. 1. The structure of FIG. 3 is partially similar to that of FIG. 2, so the same elements refer to the same reference numbers. It is worth noting that, in order to prevent the structure of FIG. 3 from being blurred, the metal wool components are not depicted in FIG. 3. Referring to FIG. 3, the steam recycling apparatus 100 further includes a ventilation structure 95, which is disposed on the outer surface 11 of the housing 10, connects the chamber 30 to an external environment, and adjusts the pressure of the chamber 30. These sub-chambers further include a spray chamber 36A and an exhaust chamber 36B both disposed above the peripheral sub-chambers 32 to 39. The spraying heads 60 provide the cooling spray past the spray chamber 36A to one portion or the entire portion of the metal wool components 81, and the ventilation structure 95 is directly connected to the exhaust chamber 36B. Thus, a portion of space can be provided for the cooling spray to enter the metal wool components 81, and the metal wool components 81 cannot directly block the spraying areas of the spraying heads 60. It is understandable that the ventilation structure 95 needs not to be present concurrently with the spray chamber 36A and the exhaust chamber 36B, and the pressure of the chamber 30 in FIG. 2 may also be adjusted. In this example, the mesh steam tunnel 40 includes metal meshes 41 to 45 (e.g., stainless steel meshes) each extending in a vertical direction. The metal meshes 41 to 45 are arranged in a horizontal direction. It is understandable that the metal meshes 41 to 45 may be configured to overlap with the mesh partitions 80 in a front view, but this disclosure is not restricted thereto. In addition, the mesh hole of the metal mesh 41 close to the steam inlet 50 is greater than the mesh hole of the metal mesh 45 away from the steam inlet 50. That is, the coarse stainless steel metal mesh is used at the beginning and provides the function of reducing the energy and pressure as well as the function of silencing. Because the pressure and kinetic energy of the steam have been reduced, the mesh holes of the following stainless steel metal meshes can be gradually decreased. For example, the dimensions of the mesh holes of the metal meshes 41 to 45 are gradually decreased (hole of mesh 45<hole of mesh 44<hole of mesh 43<hole of mesh 42<hole of mesh 41) to achieve the effects of decreasing the pressure and kinetic energy of the steam in stages. In FIG. 3, the inclined plate 82 is inclined downward from left to right.

With the steam recycling apparatus of the embodiment, the long steam tunnel can be used to buffer the flow of the high-pressure steam, and the layers of metal meshes can be used to reduce the energy and pressure of the steam, and then the metal wool components are used to absorb the steam and perform silencing. Thus, quick cooling can be achieved by air cooling and water cooling, and the low-noise steam recycling can be achieved.

The specific embodiments proposed in the detailed description of this disclosure are only used to facilitate the description of the technical contents of this disclosure, and do not narrowly limit this disclosure to the above-mentioned embodiments. Various changes of implementations made without departing from the spirit of this disclosure and the scope of the claims are deemed as falling within the following claims.

The invention claimed is:

1. A tunnel type hybrid cooling steam recycling apparatus, comprising:

a housing;

air-cooling heat exchanging plates disposed on an outer surface of the housing;

a chamber formed in the housing;

a mesh steam tunnel disposed in the chamber;

a steam inlet penetrating through the housing;

spraying heads disposed in the chamber;

a water outlet penetrating through the housing, wherein steam supplied into the mesh steam tunnel through the steam inlet is condensed into condensed water, wherein in a hybrid mode, the spraying heads provide cooling spray into the chamber to dissipate heat in a hybrid manner in conjunction with the housing and the air-cooling heat exchanging plates; and mesh partitions which partition, in a horizontal direction and a vertical direction, the chamber into sub-chambers connected together, wherein the sub-chambers comprise a middle sub-chamber and peripheral sub-chambers surrounding the middle sub-chamber, wherein the mesh steam tunnel is positioned in the middle sub-chamber.

2. The tunnel type hybrid cooling steam recycling apparatus according to claim 1, wherein metal wool components are disposed in the peripheral sub-chambers, and configured to absorb the steam, perform silencing and condense the steam into the condensed water, and the spraying heads are configured to provide the cooling spray to one portion or an entire portion of the metal wool components.

3. The tunnel type hybrid cooling steam recycling apparatus according to claim 2, further comprising a ventilation structure, which is disposed on the outer surface of the housing, connects the chamber to an external environment, and is configured to adjust a pressure of the chamber, wherein the sub-chambers further comprise a spray chamber and an exhaust chamber disposed above the peripheral sub-chambers, the spraying heads are configured to provide the cooling spray past the spray chamber and are configured to spray the cooling spray to the one portion or the entire portion of the metal wool components, and the ventilation structure is directly connected to the exhaust chamber.

4. The tunnel type hybrid cooling steam recycling apparatus according to claim 1, further comprising inclined plates for guiding the condensed water to flow to the water outlet.

5. The tunnel type hybrid cooling steam recycling apparatus according to claim 1, further comprising:

a control device;

a cooling water supply source, which is electrically connected to the control device and is connected to the spraying heads via a physical conduit, wherein the cooling water supply source provides cooling water to the spraying heads generating the cooling spray; and a temperature sensor, which is disposed on the housing or one of the air-cooling heat exchanging plates, and is electrically connected to the control device.

6. The tunnel type hybrid cooling steam recycling apparatus according to claim 5, wherein: the control device is configured to control, according to a temperature signal of the temperature sensor, the cooling water supply source to provide the cooling water to the spraying heads generating the cooling spray; when a temperature represented by the temperature signal is higher than a predetermined temperature, the control device enters the hybrid mode; and when the temperature represented by the temperature signal is lower than or equal to the predetermined temperature, the control device enters an air cooling mode, and controls the cooling water supply source not to provide the cooling water to the spraying heads, which do not generate the cooling spray.

7. The tunnel type hybrid cooling steam recycling apparatus according to claim 1, further comprising:

a ventilation structure, which is disposed on the outer surface of the housing, connects the chamber to an external environment, and is configured to adjust a pressure of the chamber.

8. The tunnel type hybrid cooling steam recycling apparatus according to claim 1, wherein the mesh steam tunnel comprises metal meshes each extending in the vertical direction, and the metal meshes are disposed in the horizontal direction.

9. The tunnel type hybrid cooling steam recycling apparatus according to claim 8, wherein mesh holes of one of the metal meshes close to the steam inlet are larger than mesh holes of one of the metal meshes away from the steam inlet.

* * * * *